US006737759B2

(12) United States Patent
Osada et al.

(10) Patent No.: US 6,737,759 B2
(45) Date of Patent: May 18, 2004

(54) ENGINE STARTER SYSTEM HAVING DUTY-CONTROLLED SWITCHING DEVICE

(75) Inventors: Masahiko Osada, Okazaki (JP); Mikio Saito, Motosu-gun (JP); Masato Hanai, Atsumi-gun (JP)

(73) Assignee: Denso Corporation, Kariya (JP)

( * ) Notice: Subject to any disclaimer, the term of this patent is extended or adjusted under 35 U.S.C. 154(b) by 112 days.

(21) Appl. No.: 10/040,444

(22) Filed: Jan. 9, 2002

(65) Prior Publication Data

US 2002/0140291 A1 Oct. 3, 2002

(30) Foreign Application Priority Data

Apr. 2, 2001 (JP) ..... 2001-103119

(51) Int. Cl.[7] ..... F02N 11/08
(52) U.S. Cl. ..... 307/10.6
(58) Field of Search ..... 307/10.6

(56) References Cited

U.S. PATENT DOCUMENTS 5,967,106 A * 10/1999 Schulze et al. ..... 307/10.6
6,249,419 B1 * 6/2001 Casellato ..... 307/10.6
6,434,475 B2 * 8/2002 Kaneko et al. ..... 307/10.6
6,466,860 B2 * 10/2002 Kaneko et al. ..... 307/10.6
6,564,765 B2 * 5/2003 Kuroda et al. ..... 307/10.6

FOREIGN PATENT DOCUMENTS

JP 4-334758 A 11/1992 ..... F02N/11/08

* cited by examiner

*Primary Examiner*—Jeffrey Sterrett
(74) *Attorney, Agent, or Firm*—Oliff & Berridge, PLC

(57) ABSTRACT

An engine starter system includes a current switching device for controlling an armature current, a shorting relay for electrically shorting the current switching device, and an electronic control circuit. In a normal starting mode, the electronic control circuit gradually increases the armature current by varying a duty ratio of the current switching device. When the armature current becomes larger than an allowable current value of the current switching device, an armature is energized through the shorting relay. In an economy-running starting mode, the armature current is controlled through the current switching device until the engine is completely started.

15 Claims, 2 Drawing Sheets

ENGINE STARTER SYSTEM HAVING DUTY-CONTROLLED SWITCHING DEVICE

CROSS REFERENCE TO RELATED APPLICATION

This application is based on and incorporates herein by reference Japanese Patent Application No. 2001-103119 filed on Apr. 2, 2001.

BACKGROUND OF THE INVENTION

The present invention relates to an engine starter system for starting an engine.

In a conventional engine starter system, when an engine key switch is turned on, a solenoid switch generates magnetic power with its exciting winding being energized. When a plunger, moved by the magnetic power, closes contact points for a motor of the starter, a hitting sound is generated. In order to reduce the hitting sound, a large current (rush current) is required to be restricted when the key switch is turned on. Therefore, a current restricting device is connected to the exciting winding in series, thereby restricting a current flowing into the exciting winding by the current restricting device.

However, the output of the starter is reduced due to a voltage drop at the current restricting device. Further, when the capacity of a battery is reduced and the voltage of the battery is reduced by energizing the motor, the operation of starting the engine cannot be sometimes maintained due to the voltage drop at the current restricting device. Furthermore, a low-cost current restricting device is desired to be used in the engine starter system for reducing the production cost of the engine starter system.

SUMMARY OF THE INVENTION

The present invention therefore has an object to provide an improved engine starter system.

Further, the present invention has an object to provide an engine starter system, which can surely start an engine even when the capacity of a battery is reduced.

According to the present invention, an engine starter system includes a first energizing circuit having a current switching device, a second energizing circuit having a relay, and an electronic control circuit for controlling the operations of the current switching device and the relay. The current switching device and a motor armature are connected in series, and the relay contact points and the armature are connected in series. The first energizing circuit energizes the armature by turning on the current switching device, and the second energizing circuit energizes the armature by closing the relay contact points.

Accordingly, the armature can be energized by suitably changing any one of the first and second energizing circuits. For example, when an engine is started, the armature is energized by turning on and off the current switching device with a varying duty ratio, so that the current flowing through the armature is controlled to increase gradually for reducing a rush current. When a large current is required, the armature is energized by closing the relay contact points thereby shorting the switching device.

BRIEF DESCRIPTION OF THE DRAWINGS

Additional objects and advantages of the present invention will be more readily apparent from the following detailed description of preferred embodiments when taken together with the accompanying drawings in which.

DETAILED DESCRIPTION OF THE PREFERRED EMBODIMENTS

The present invention will be described hereinafter with reference to various embodiments.

(First Embodiment)

Figure 1:
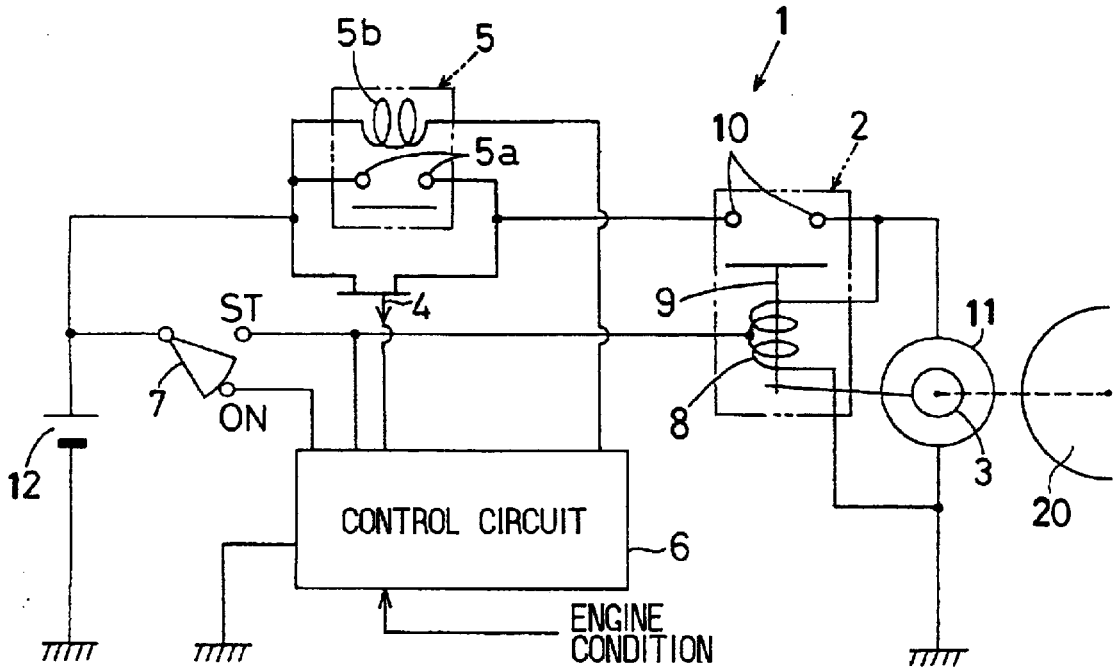
FIG. 1 is a circuit diagram of an engine starter system according to the first embodiment of the present invention.

As shown in FIG. 1, an engine starter system 1 has a solenoid switch 2 mounted on a starter (not shown), which has a pinion 3 and an armature 11. This solenoid switch 2 pushes the pinion 3 to be engaged with a ring gear 20 of an engine (not shown) by its driving force. As rotation force of a starter motor is transmitted from the pinion 3 to the ring gear 20, the engine is started. The starter system 1 includes a duty-controlled current switching device 4 for controlling the current flowing through the armature 11, a shorting relay 5 connected in parallel with the current switching device 4 for electrically shorting the current switching device 4, and an electronic control circuit 6.

The solenoid switch 2 includes an exciting winding 8, a plunger 9, inside contact points 10 and the like. The exciting winding 8, energized when a key switch 7 is turned on to a starting position ST, generates magnetic power, so that the plunger 9 is moved by the magnetic force to engage the pinion 3 with the ring gear 20. According to the movement of the plunger 9, the inside contact points 10 are opened and closed. The starter motor is a D.C. motor where the armature 11, when energized, generates rotation force.

The current switching device 4, connected in the wiring between a battery 12 and one of the inside contact points 10, is controlled in a pulse width modulation (PWM) by the electronic control circuit 6. That is, the current switching device 4 is turned on and off repeatedly with a varying duty ratio to vary the current supplied to the armature 11. The relay 5 is composed of relay contact points 5*a* and an exciting winding 5*b* for opening and closing the relay contact points 5*a*. The relay contact points 5*a* and the current switching device 4 are connected in parallel. The electronic control circuit 6 is operated by the battery 12 when the key switch 7 is turned on to a power-on position ON. The electronic control circuit 6 controls the operation of the current switching device 4 and the relay (exciting winding 5*b*) based on engine condition signal, a current flowing through the armature 11 (armature current), a starting mode signal and the like. The engine condition signal is a rotation speed of the engine, for example.

The starting mode signal is a normal starting mode signal for performing a normal starting mode and an economy-running starting signal for performing an economy-running starting mode, for example. In the normal starting mode, the engine is started by turning on the key switch 7 to the starting position ST. In the economy-running starting mode, the engine is automatically started without turning the key switch 7 to the starting position ST, when a predetermined condition (e.g., starting to depress an accelerator pedal after releasing a brake pedal) is satisfied. This economy-running starting mode is initiated when a vehicle starts to run after an engine stop at a traffic light.

Next, description will be made on operation of the engine starter system 1. In the normal starting mode, when the key switch 7 is turned on to the starting position ST, the exciting winding 8 is energized to move the plunger 9 so that the pinion 3 is engaged with the ring gear 20 and the contact points 10 are closed. The electronic control circuit 6 controls the current switching device 4 in a PWM and gradually increases the armature current by gradually increasing the duty ratio. Thereafter, when the armature current becomes larger than an allowable current value because the engine requires a larger starter torque under the low temperature condition, the electronic control circuit 6 energies the exciting winding 5*b*, so that the relay contact points 5*a* are closed to short the current switching device 4. Thus, the armature current is supplied continuously from the battery 12 through the relay contact points 5*a*, and the armature 11 is energized without being interrupted by the current switching device 4.

When the engine is completely driven and energizing the armature 11 is stopped by turning off the key switch 7 from the starting position ST, the inside contact points 10 are opened by opening the relay contact points 5*a* by stopping energizing the exciting winding 5*b*. When the inside contact points 10 of the solenoid switch 2 melt and do not open the circuit for some reason, the relay contact points 5*a* are opened and the current switching device 4 is held turned off, thereby preventing the exciting winding 8 of the solenoid switch 2 from being overheated.

In the economy-running starting mode where the engine can be started using a current lower than the allowable current value of the current switching device 4 because the engine is warm and requires less starter torque, the armature current is controlled through the current switching device 4 until the engine is completely started. In this case, the armature current is controlled so as to follow the fluctuation of cranking torque of the engine.

As described above, the engine starter system 1 includes a first energizing circuit for energizing the armature 11 by turning on and off the current switching device 4 with the gradually increasing duty ratio and a second energizing circuit for energizing the armature 11 by closing the relay contact points 5*a*. Therefore, for example, when the engine is started, the current switching device 4 is turned on, and the armature current is gradually increased using the current switching device 4. In this case, a large current (rush current) can be prevented from flowing through the armature 11 at the time of starting to energize the armature 11, thereby restricting useless electric power consumption.

When the armature current becomes larger than the allowable current value of the current switching device 4, the current switching device 4 can be electrically shorted by closing the relay contact points 5*a*, so that the armature current flows through the relay contact points 5*a*. As a result, a low-current switching device can be used for the current switching device 4. In this case, a voltage drop at the current switching device 4 can be eliminated, thereby restricting the output of the engine starter system 1 from being reduced.

At the time of stopping energizing the armature 11, the solenoid switch 2 is turned off after opening the relay contact points 5*a*. Therefore, when the inside contact points 10 of the solenoid switch 2 are opened, an arc current can be prevented from being generated at the inside contact points 10, thereby lengthening the lifetime of the inside contact points 10.

In the economy-running starting mode, the armature 11 can be energized by controlling only the current switching device 4 while the relay contact points 5*a* are opened, thereby reducing the frequency of using the relay contact points 5*a* and improving the durability of the relay contact points 5*a*. In the economy-running starting mode, the current switching device 4 is controlled so that the armature current follows the fluctuation of cranking torque of the engine, so that the rotation speed of the armature 11 can be controlled in accordance with the rotation speed of the engine. Therefore, the starting sound at the time of cranking the engine can be reduced.

(Second Embodiment)

Figure 2:
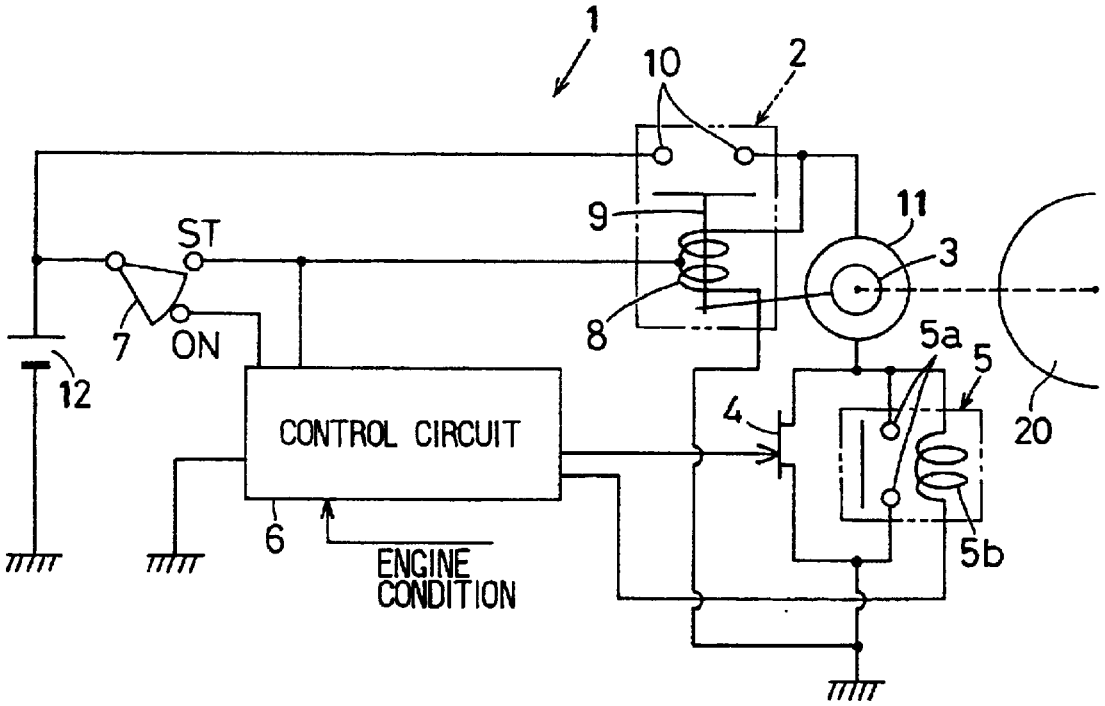
FIG. 2 is a circuit diagram of an engine starter system according to the second embodiment of the present invention.

As shown in FIG.2, in the engine starter system 1 according to the second embodiment, the current switching device 4 and the relay contact points 5*a* are connected in the wiring between the armature 11 and the ground terminal at the lower voltage side of the armature 11. The control method for the current switching device 4 and the relay 5 (exciting winding 5*b*) is identical to that in the first embodiment, thereby obtaining the same operational effect as in the first embodiment. Since the current switching device 4 is connected in the wiring at the lower voltage side of the armature 11, the current switching device 4 can withstand a high voltage.

(Third Embodiment)

Figure 3:
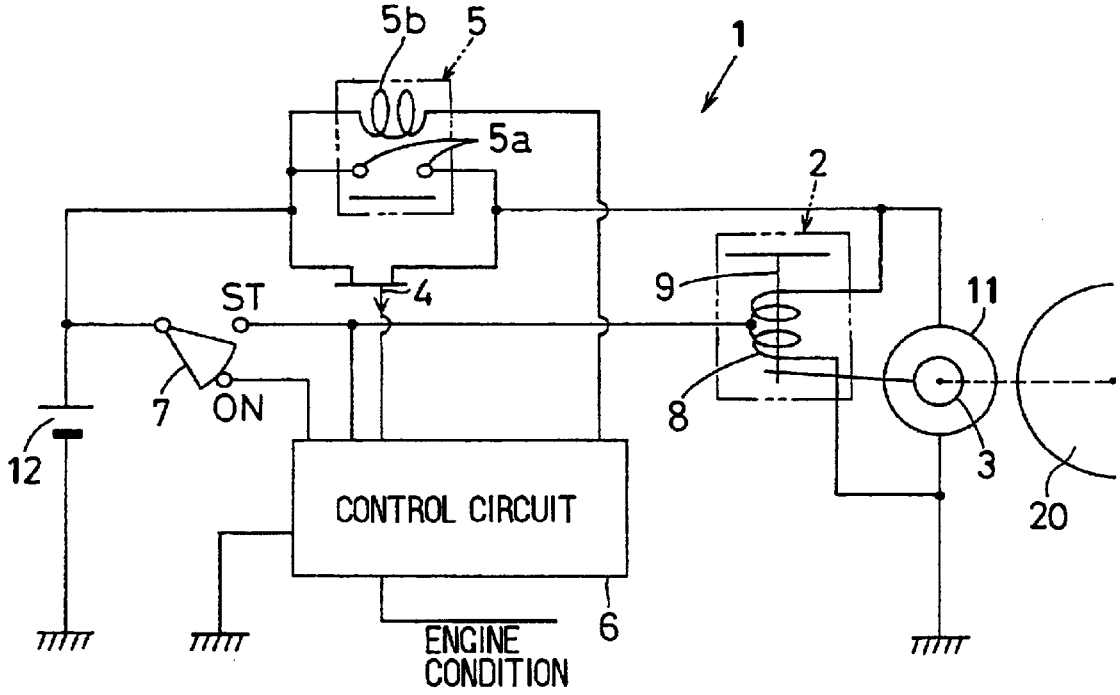
FIG. 3 is a circuit diagram of an engine starter system according to the third embodiment of the present invention.

As shown in FIG. 3, in the engine starter system 1 according to the third embodiment, the solenoid switch 2 has no inside contact points (10 in FIG. 1). The armature 11 is directly connected to the first energizing circuit and the second energizing circuit, the solenoid switch 2 is used only for pushing out the pinion 3 for engagement with the ring gear 20. In this case, for example, in the economy-running starting mode, the pinion 3 can be maintained to be engaged with the ring gear 20 while the solenoid switch 2 is maintained energized. Therefore, the engine can be started in a short time.

(Other Embodiments)

In the above embodiments, the electronic control circuit 6 may be constructed to determine the time of closing the relay contact points 5*a* based on any one of the time passing after the current switching device 4 is turned on, the armature current, the rotation speed of the engine and the rotation speed of the armature 11. In this case, too, when the current flowing through the current switching device 4 becomes larger than the allowable current value, the relay contact points 5*a* may be closed.

Further, when predetermined time passes after the electronic control circuit 6 turns on the current switching device 4, the electronic control circuit 6 may turn off the current switching device 4 and open the relay contact points 5*a*. In this case, for example, even when the solenoid switch 2 is electrically shorted, the energization of the armature 11 can be stopped by turning off the current switching device 4 and opening the relay contact points 5*a*.

While the present invention has been shown and described with reference to the foregoing preferred embodiments, it will be apparent to those skilled in the art that changes in form and detail may be made therein without departing from the scope of the invention.

What is claimed is:

1. An engine starter system for starting an engine, comprising:

a starter motor having an armature for generating rotation force;

a pinion movable to transmit the rotation force from the armature to a ring gear of the engine;

a solenoid switch including an exciting winding and a plunger, the plunger being for engaging the pinion with the ring gear by pushing the pinion, and the exciting winding being for moving the plunger using magnetic force generated by energizing the exciting winding;

a first energizing circuit including a current switching device connected to the armature in series, for energizing the armature by turning on the current switching device;

a second energizing circuit including a relay with relay contact points connected to the armature in series, for energizing the armature by closing the relay contact points; and an electronic control circuit for controlling an operation of the current switching device and an operation of the relay contact points, wherein the second energizing unit is connected in parallel with the first energizing circuit.

2. The engine starter system according to claim 1, wherein the current switching device is connected in a wiring at any one of a higher voltage side of the armature and a lower voltage side thereof.

3. The engine starter system according to claim 1, wherein the electronic control circuit is constructed to control the operation of the current switching device and the operation of the relay contact points according to engine starting modes, the modes including a normal starting mode where the engine is started by turning on a key switch and an economy-running starting mode where the engine is automatically started when a predetermined condition is satisfied without turning on the key switch.

4. The engine starter system according to claim 1, wherein the electronic control circuit is constructed to energize the armature by turning on the current switching device when the engine is started and gradually increase a current flowing through the armature.

5. The engine starter system according to claim 1, wherein the electronic control circuit is constructed to close the relay contact points when a current flowing through the current switching device becomes larger than an allowable current value of the current switching device.

6. The engine starter system according to claim 1, wherein the electronic control circuit is constructed to determine a time of closing the relay contact points based on at least one of time passing after turning on the current switching device, the current flowing through the armature, a rotation speed of the engine and a rotation speed of the starter motor.

7. The engine starter system according to claim 1, wherein the electronic control circuit is constructed to stop energizing the solenoid switch after opening the relay contact points at a time of stopping energizing the armature.

8. The engine starter system according to claim 1, wherein the electronic control circuit is constructed to turn off the current switching device and open the relay contact points when predetermined time passes after turning on the current switching device.

9. The engine starter system according to claim 1, wherein the solenoid switch has no inside contact points through which the armature is energized.

10. The engine starter system according to claim 1, wherein the electronic control circuit is constructed to repeatedly turn on and off the current switching device with a varying duty ratio to vary a current flowing through the armature.

11. A method of starting an engine comprising the steps of:

supplying a current to an armature of a starter through a current switching device with a varying duty ratio, which gradually increases the current; and supplying the current to the armature through relay contacts of a relay connected in parallel with the current switching device, when a predetermined condition is satisfied.

12. The method as in claim 11, wherein the predetermined condition includes at least one of time passing after turning on the current switching device, the current flowing through the armature, a rotation speed of the engine and a rotation speed of the armature.

13. An engine starter system for starting an engine, comprising:

a starter motor having an armature for generating rotation force;

a pinion movable to transmit the rotation force from the armature to a ring gear of the engine;

a solenoid switch including an exciting winding and a plunger, the plunger being for engaging the pinion with the ring gear by pushing the pinion, and the exciting winding being for moving the plunger using magnetic force generated by energizing the exciting winding;

a first energizing circuit including a current switching device connected to the armature in series, for energizing the armature by turning on the current switching device;

a second energizing circuit including a relay with relay contact points connected to the armature in series, for energizing the armature by closing the relay contact points; and an electronic control circuit for controlling an operation of the current switching device and an operation of the relay contact points, wherein the electronic control circuit is constructed to close the relay contact points when a current flowing through the current switching device becomes larger than an allowable current value of the current switching device.

14. The engine starter system according to claim 13, wherein the electronic control circuit is constructed to determine a time of closing the relay contact points based on at least one of time passing after turning on the current switching device, the current flowing through the armature, a rotation speed of the engine and a rotation speed of the starter motor.

15. An engine starter system for starting an engine, comprising:

a starter motor having an armature for generating rotation force;

a pinion movable to transmit the rotation force from the armature to a ring gear of the engine;

a solenoid switch including an exciting winding and a plunger, the plunger being for engaging the pinion with the ring gear by pushing the pinion, and the exciting winding being for moving the plunger using magnetic force generated by energizing the exciting winding;

a first energizing circuit including a current switching device connected to the armature in series, for energizing the armature by turning on the current switching device;

a second energizing circuit including a relay with relay contact points connected to the armature in series, for energizing the armature by closing the relay contact points; and an electronic control circuit for controlling an operation of the current switching device and an operation of the relay contact points, wherein the electronic control circuit is constructed to stop energizing the solenoid switch after opening the relay contact points at a time of stopping energizing the armature.

* * * * *